United States Patent [19]

Stoner

[11] Patent Number: 4,917,598

[45] Date of Patent: Apr. 17, 1990

[54] FUEL OIL LAMP AND METHOD OF CONSTRUCTION

[76] Inventor: Daniel P. Stoner, 11914 Hartland Pl., Moreno Valley, Calif. 92388

[21] Appl. No.: 397,183

[22] Filed: Aug. 23, 1989

[51] Int. Cl.[4] ..... F23D 3/24

[52] U.S. Cl. ..... 431/320; 362/180; 362/163

[58] Field of Search ..... 431/320; 362/162, 163, 362/180

[56] References Cited

U.S. PATENT DOCUMENTS 4,728,286 3/1988 Olsen ..... 431/320

4,805,076 2/1989 Menter ..... 431/320

*Primary Examiner*—Carroll B. Dority

*Attorney, Agent, or Firm*—John S. Christopher

[57] ABSTRACT

A fuel oil lamp having a large replaceable oil vessel with an interference ring molded about the exterior perimeter of the vessel for creating sufficient securing force between the exterior surface of the vessel and the interior surface of a base sleeve while eliminating intolerable binding frictional forces therebetween, the vessel being easily inserted into and removed from the open bottom of the base sleeve permitting a chimney mounted above the vessel and base sleeve to assume any construction and inside diameter, the oil lamp having simple lines which are esthetically pleasing, is economical to produce and conveniently positioned for packing.

14 Claims, 2 Drawing Sheets

FUEL OIL LAMP AND METHOD OF CONSTRUCTION

BACKGROUND OF THE INVENTION

The invention relates to oil lamps for use in esthetic illumination, and more particularly, to an oil lamp of the type having a large oil vessel for extending the burning cycle of the lamp and a molded interference ring for securing the vessel to a base sleeve.

In the field of illumination design, burning oil lamps have been known for centuries. In past agrarian societies, farm lamps and table lamps incorporated an oil vessel within the construction of the lamp. Therefore, the burning oil medium was deposited directly into the oil vessel within the lamp as by pouring. This method resulted in an untidy and dangerous task often creating a fire hazard, which was unsatisfactory.

A later generation of oil burning lamps incorporated a disposable cartridge or vessel which generally eliminated the untidy and hazardous task of replenishing the spent oil in the vessel of the lamp. Many designs of the oil burning lamp which incorporated the disposable cartridge employed a chimney having a maximum diameter of about three inches. Therefore, the disposable cartridge which was fitted into the oil vessel of the lamp was required to be small to fit through the narrow chimney since this generation of lamps normally had a closed bottom surface. Because the disposable cartridge was relatively small, the oil lamp exhibited a short burning cycle.

In keeping with this design, later generations of oil burning lamps were fabricated for accommodating an oil vessel which was also inserted through the chimney. Because the chimney normally was limited to a relatively small diameter, the oil vessel was limited in size. Because the chimney seated in the lamp base, the diameter of the chimney limited the size of the oil vessel that could be placed into the lamp through the chimney. Further, in situations where the chimney was removable from the base of the lamp, a large oil vessel would still interfere with the proper fitting between the chimney and the base of the lamp. Since the bottom of the base for this generation of lamps was normally sealed for supporting the oil vessel, a larger oil vessel could not be inserted into the lamp from the bottom of the base.

In more recent designs, oil burning lamps have been comprised of an oil vessel which was inserted into an outer sleeve which was intended to secure the vessel and to support a chimney which expended the residue of the spent oil and served to transmit the light from the burning flame. Both the oil vessel and the sleeve were comprised of metal. This design was generally unsuccessful because although the engineering tolerances between the metal sleeve and vessel were achievable, the end product produced in mass production did not operate properly.

More current designs of the structure of oil lamps employing a removable oil vessel resulted in the size of the oil vessel being designed so that the sleeve slides over the vessel. One of the major problems associated with this design was that if the vessel is not properly secured within the sleeve, the impulse was to design a larger oil vessel for grasping the inner surface of the base sleeve. However, this design was also unsuccessful because when the outer diameter of the oil vessel was increased to interface with the inner diameter of the base sleeve, too much of the outer surface of the oil vessel contacted the inner surface of the base sleeve. This situation created too much braking surface so that it was very difficult to insert the oil vessel into and remove the oil vessel from the base sleeve.

In more current generations of the vessel-sleeve design of oil burning lamps, high strength molded plastics have been employed. However, the practical aspects of employing engineering molds for such an application do not permit the tolerances to be so exact as to cause the base sleeve and oil vessel to fit snugly but still avoid binding friction.

Hence, those concerned with the development and use of burning oil lamps in the field of esthetic illumination design have long recognized the need for an improved oil lamp structure which employs a larger oil vessel for providing a longer burning cycle, which can be inserted into the oil lamp through the lamp base notwithstanding the size of the chimney, which will be snugly secured to the lamp base yet be easily removed, which is comprised of materials which will not create intolerable binding friction, which is economical to produce over other lamp designs of the past, which exhibits simple lines and is esthetically pleasing, and the elements of which may be conveniently manipulated in position to accommodate packing and shipping.

SUMMARY OF THE INVENTION

Briefly, and in general terms, the present invention provides a new and improved oil lamp construction which substantially improves the securing force between an outer sleeve and a removable fuel oil vessel fitted within the outer sleeve while eliminating intolerable binding frictional forces therebetween by employing dissimilar materials, and which significantly extends the burning cycle of the oil lamp. Moreover, the lamp construction of the present invention permits the oil vessel to be inserted through the base of the lamp notwithstanding the size of the chimney, permits the oil vessel to be easily removed from the sleeve, is economical to produce over lamp designs of the past, exhibits simple lines and is esthetically pleasing, and may be conveniently positioned to accommodate packing and shipping.

Basically, the present invention is directed to an improved oil lamp and method of construction for providing a snug securing force between the sleeve and the oil vessel while eliminating intolerable binding frictional forces. This is accomplished by modifying the design of the oil vessel for including an interference ring about the outer circumference of the vessel.

In accordance with the invention, as a force is applied for inserting the oil vessel into the open bottom of the sleeve, the interference ring acts to provide a braking force for holding the vessel to the sleeve.

In accordance with the improved method of the present invention, as the oil vessel is inserted into the open bottom of the oil vessel, the resilient interference ring is compressed against the inner surface of the sleeve which develops a clutching or braking force for holding the sleeve to the vessel. As the vessel is further inserted into the sleeve, an upper shoulder of the vessel is intercepted by a reduced diameter in the sleeve which terminates the forward travel of the vessel through the sleeve. In this regard, the vessel and sleeve are snugly secured while an oppositely applied force permits the ready separation of the two.

The new and improved oil lamp and method of construction of the present invention develops a securing force between the sleeve and the oil vessel providing a snug fit while eliminating binding frictional forces which prevent the insertion of the vessel into the sleeve. Also, because the oil vessel is inserted through the bottom of the sleeve, a larger oil vessel may be employed extending the burning cycle of the lamp notwithstanding the size of the chimney mounted on top of the sleeve. However, the oil vessel is easily removed from the sleeve with the entire lamp having only a few major elements which may be conveniently nested for accommodating packing and shipping.

These and other features and advantages of the invention will become apparent from the following detailed description, when taken in conjunction with the accompanying drawings, which illustrate, by way of example, the features of the invention.

DETAILED DESCRIPTION

Figure 1:
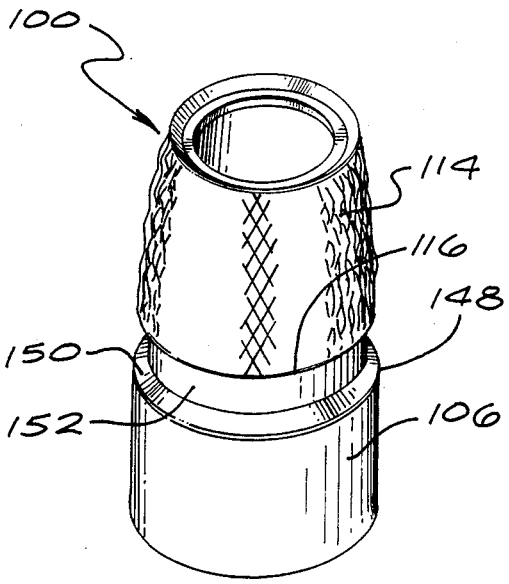
FIG. 1 is a perspective view of a fuel oil lamp in accordance with the present invention.

As shown in the drawings for purposes of illustration, the invention is embodied in a fuel oil lamp 100 of the type having a large disposable oil vessel 102 comprising a resilient interference ring 104 formed about the outer circumference of the vessel for creating a clutching or braking force between the vessel 102 and an outer base sleeve 106 when the vessel is inserted through an open bottom 108 of the sleeve 106. When the vessel reaches the end of the travel through the sleeve, the braking force provides a snug fit for holding the sleeve 106 to the vessel 102 but permits ready separation of the two components upon applying an oppositely directed force.

In the past, fuel oil lamps incorporated an oil vessel within the lamp which accommodated the fuel oil poured into the vessel. Because this created an untidy and hazardous condition, disposable cartridges or vessels were developed to avoid the mess and hazard. However, because the fuel oil lamps were comprised of a sealed bottom, the disposable vessel was necessarily required to be small in order to pass through the top of the chimney and into the oil vessel. The small disposable vessel resulted in a short burning cycle. Therefore, this construction resulted in a problem common to all oil lamps having a sealed bottom. This was the case even if the chimney was removable since the top diameter of the base necessarily was narrower to receive the bottom of the chimney.

In later constructions, if the size of the vessel was designed so that the sleeve slid over the vessel and the vessel was thereafter not held within the sleeve, then the impulse was to make the vessel wider. However, by reducing the tolerance between the vessel and the sleeve, a higher percentage of the surface area of the vessel and the sleeve interfaced creating a very high braking surface. This resulted in an intolerable binding force which would impede the insertion of the oil vessel into the sleeve or the removal of the vessel from the sleeve. A construction of the past incorporated both a sleeve and a vessel comprised of metal. Although the tolerances between the metal sleeve and the metal vessel were achievable, the combination was unsuitable for mass production and therefore was unsuccessful. Further, upon employing plastic materials, the tolerances of plastic molds were not so exact as to permit the sleeve and the vessel to achieve a snug fit but still avoid intolerable binding forces.

In accordance with the present invention, the interference ring 104 formed on the exterior surface 110 of the oil vessel 102 and the smooth inside surface 112 of the base sleeve 106 cooperate to create sufficient securing force between the vessel 102 and the sleeve 106 to provide a snug fit therebetween while eliminating intolerable binding frictional forces, and to significantly extend the burning cycle of the oil lamp 100 by employing a large oil vessel 102. Further, the oil lamp construction permits the vessel to be inserted through the bottom of the sleeve 106 notwithstanding the size of the inside diameter of a chimney 114 mounted over the sleeve, permits the oil vessel to be easily removed from the sleeve, is relatively economical to produce, exhibits simple lines and is esthetically pleasing, and may be conveniently positioned to accommodate packing and shipping.

The oil vessel 102 is molded and shaped to accommodate the insertion into the base sleeve 106. The oil vessel may be comprised of a resilient synthetic material such as plastic having tolerances which approximate, but cannot be fabricated to create, a snug fit within the sleeve 106 without creating intolerable binding forces. If the outer diameter of the oil vessel is slightly small, the oil vessel will not be snugly secured to the inside surface 112 of the sleeve 106.

Figure 2:
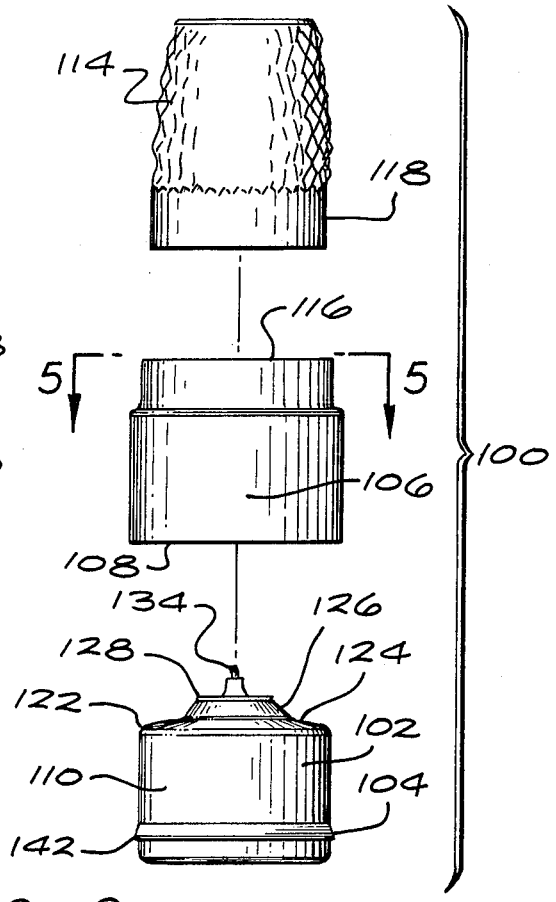
FIG. 2 is an exploded view of the fuel oil lamp of FIG. 1 showing an oil vessel, an outer sleeve and a chimney.

When the oil vessel 102 is secured within the sleeve 106, and the chimney 114 is mounted on top of the vessel through an open top 116 of the sleeve, the oil vessel is not visible as is shown in FIG. 1. Upon employing a minor force to the top of the oil vessel 102 while holding the sleeve 106 securely, the vessel can be ejected from the open bottom 108 of the sleeve. Likewise, the chimney 114 need only be lifted out of the open top 116 of the sleeve, the sleeve receiving a reduced diameter ring 118 located at the bottom of the chimney 114. An exploded view of the disassembled fuel oil lamp 100 is shown in FIG. 2.

The exterior surface 110 of the oil vessel 102 is generally cylindrical in shape, the body of which may form, for example, a right circular cylinder. A base 120 of the vessel supports the entire fuel oil lamp 100 by being seated, for example, on a table top. The exterior surface 110 of the oil vessel is generally orthogonal to the base 120 and terminates at a vessel shoulder 122 which is a generally rounded surface that interfaces with a slight inclined area 124 which terminates at a neck 126 of the oil vessel 102. The neck 126 of the vessel levels out at a plateau region 128 as shown in FIG. 3.

Mounted at the top of the plateau region 128 is a circular lip 130 which forms an open port (not shown) in the top of the oil vessel 102. The circular lip 130 is covered and sealed by a wick cap 132 which seals the open port. The wick cap 132 includes a penetration through the top thereof for accommodating a wick 134 which is immersed in a volume of fuel oil 136 contained within the oil vessel 102 as is shown in FIG. 3. The wick cap 132 may be comprised of metal and may be secured to the top of the circular lip 130 of the oil vessel 102 as by pressing. The wick is formed of a suitable material which will draw the fuel oil 136 up to the top of the wick by capillary action for permitting the fuel to be ignited by an appropriate flame source.

Figure 3:
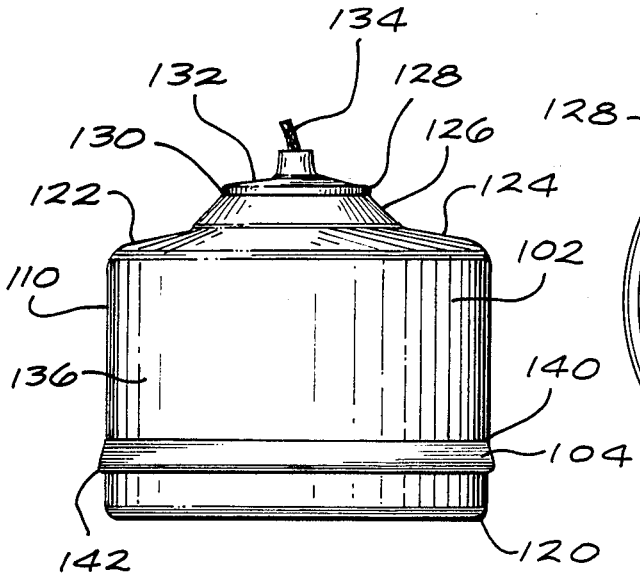
FIG. 3 is an elevational view of the oil vessel of the fuel oil lamp of FIG. 1.
Figure 4:
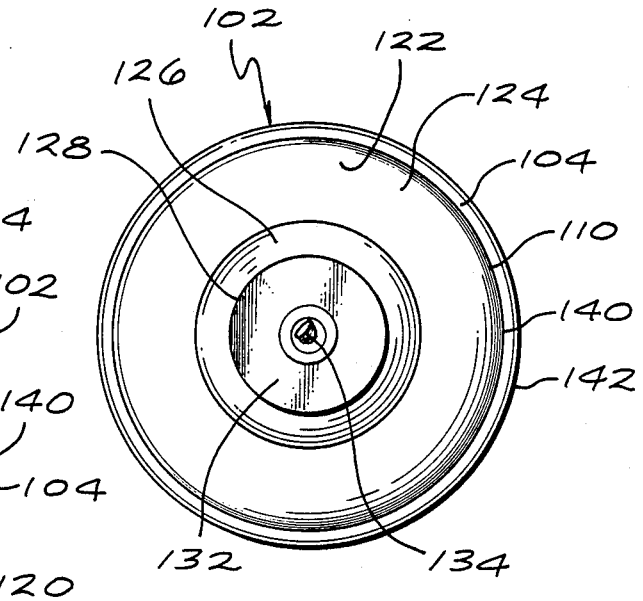
FIG. 4 is a top planar view of the oil vessel of the fuel oil lamp of FIG. 1.

Along the bottom of the vertical portions of the exterior surface 110 of the oil vessel 102 there is formed an indentation ring 140 which is positioned at the very top portion of the molded interference ring 104 as is shown in FIG. 3. The interference ring extends laterally beyond the exterior surface 110 of the vessel forming a ridge 142 which contacts the smooth inside surface 112 of the base sleeve 106 during installation. The remainder of the exterior surface 110 of the vessel located below the interference ring 104 is undercut so that the outer diameter of the oil vessel between the bottom of the interference ring and the base 120 is somewhat smaller. This fabrication feature is made possible via tooling and is provided so that the lower portion of the vessel does not interfere with the inner surface of the sleeve 106 during installation of the vessel. It should be noted that the oil vessel 102 is designed to accommodate a generous volume of fuel oil 136 which provides for a longer burning cycle. When the fuel oil 136 is expended, the oil vessel is removed from the base sleeve 106 and replaced with a recharged vessel as is shown in FIG. 2.

Figure 5:
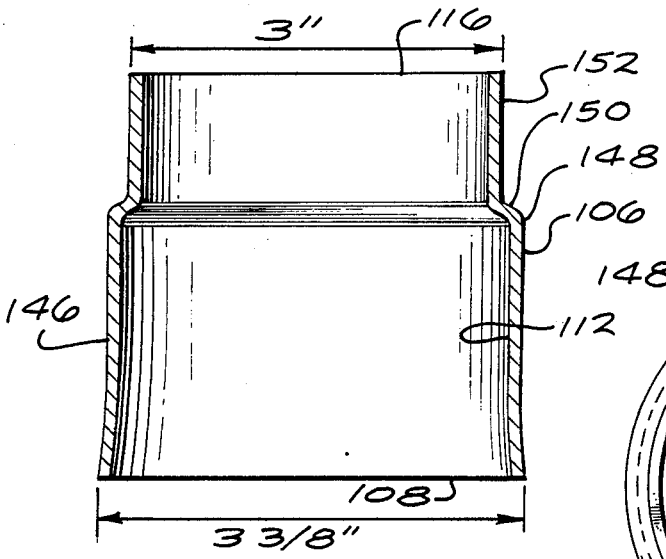
FIG. 5 is a cross-sectional view of the outer sleeve of the fuel oil lamp taken along the line 5—5 of FIG. 2.

The base sleeve 106 is also generally formed in a right circular cylindrical construction as shown in FIG. 5. The sleeve includes the open bottom 108 for receiving the oil vessel 102 and further includes a continuous sidewall 146 which is slightly tapered from the bottom to the top of the sleeve. Thus, a larger diameter, for example 3 ⅜, at the bottom of the sleeve slightly tapering to a somewhat smaller diameter of approximately 3" at the top of the sleeve permits extracting the sleeve from a spinning or punch press during fabrication. Further, the slight taper in the continuous sidewall 146 is esthetically pleasing in appearance.

Figure 6:
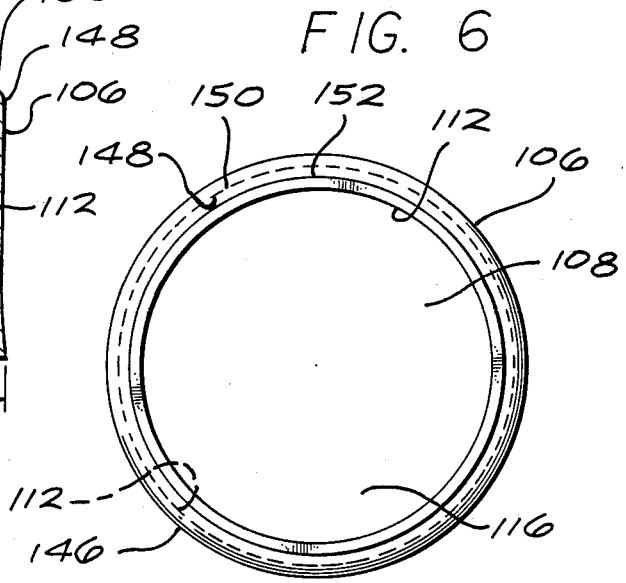
FIG. 6 is a top planar view of the outer sleeve of the fuel oil lamp of FIG. 1.
Figure 7:
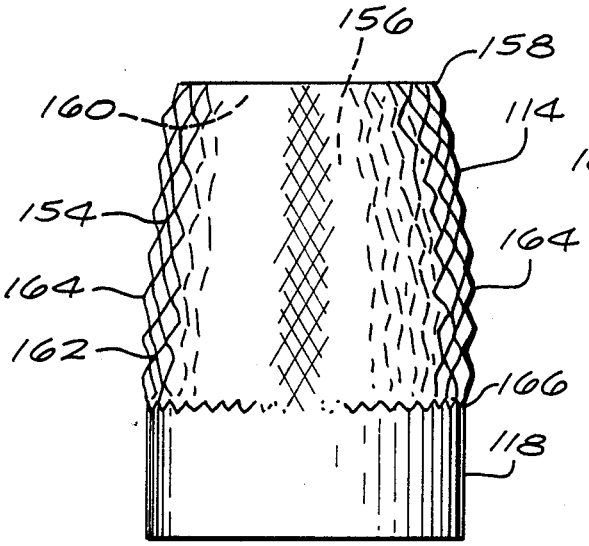
FIG. 7 is an elevational view of the chimney of the fuel oil lamp of FIG. 1.

Located at the top of the continuous sidewall 146 is a sleeve shoulder 148 which includes a slight inclined surface 150 terminating in an abrupt change in diameter for forming a top circular neck 152 of the sleeve 106. It should be noted that the sleeve shoulder 148, the slight inclined surface 150, and the top circular neck 152 each of the base sleeve 106 are formed to be congruent with the vessel shoulder 122, and the slight inclined area 124 of the oil vessel 102. Note that the top circular neck 152 of the sleeve is open at the top and includes an outer diameter of approximately three inches. The abrupt reduction in diameter from the continuous sidewall 146 to the top circular neck 152 of the sleeve 106 permits accommodating the oil vessel 102 through the open bottom 108 of the sleeve while simultaneously receiving a reduced diameter ring 118 of the chimney 114. The inner volume of the sleeve 106 functions to snugly surround the oil vessel 102, the inclined area 124 of which supports the chimney 114. However, it is the base 120 of the vessel 102 that actually supports the entire sleeve and chimney assembly. The base sleeve 106 may be comprised of metal, for example, an anodized aluminum having a smooth surface on both the continuous sidewall 146 and the inside surface 112 as is shown in FIGS. 5 and 6.

Figure 8:
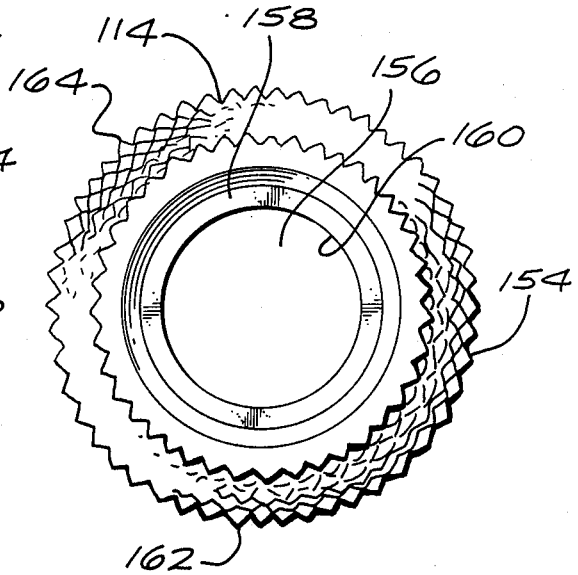
FIG. 8 is a top planar view of the chimney of the fuel oil lamp of FIG. 1.

The chimney 114 may be comprised of any suitable material such as glass and includes an outer surface 154 which is somewhat bulbed and has an open top 156 as shown in FIG. 8. Further, the open top includes a lip 158 which is comprised of a smooth declined surface while an entire inner surface 160 of the chimney is smooth for assisting in directing smoke therethrough from the spent oil.

The outer surface 154 may be formed of a plurality of glass prisms 162 for refracting and reflecting the light produced by the flame surrounding the oil saturated wick 134. The design of the chimney 114 permits the flame about the wick 134 to illuminate a table by magnifying the light produced by the flame. The outer surface 154 of the chimney 114 is bulbed at approximately a position 164 so that a taper exists between the bulbed position 164 and the open top 156 and between the bulbed position 164 and an interface ring 166 located at the top edge of the reduced diameter ring 118.

In assembly, the top circular neck 152 of the sleeve 106 extends above the vessel shoulder 122 and the slight inclined area 124 of the vessel 102. Thereafter, the reduced diameter ring 118 of the chimney 114 is inserted within the inner diameter of the circular neck 152 of the sleeve and seated upon the slight inclined area 124 of the oil vessel 102. The entire chimney 114 may be removed from the lamp 100 simply by lifting the chimney off of the inclined area 124 of the vessel. The reduced diameter ring 118 has a smooth outer surface in contrast to the plurality of glass prisms 162 covering the outer surface 154 of the chimney 114. The particular described construction of the chimney 114 is only one of many possible designs suitable in the preferred embodiment. Any construction selected could alter the outer surface 154 including the plurality of glass prisms 162. However, the reduced diameter ring 118 must be incorporated into the selected construction to permit insertion into the top circular neck 152 of the sleeve 106 for mounting on top of the inclined area 124 of the oil vessel.

In operation, the interference ring 104 formed on the exterior surface 110 of the oil vessel 102 acts as a clutch or brake by being compressed against the smooth inside surface 112 of the base sleeve 106. When the oil vessel 102 is inserted into the open bottom 108 of the sleeve, it is only the interference ring 104 that slides against the inner surface of the sleeve and holds the vessel to the sleeve. Because the oil vessel 102 including the interference ring are comprised of a resilient plastic, the interference ring will be compressed against the inside surface 112 of the sleeve. Because only the interference ring contacts the inside surface of the sleeve, intolerable binding forces which have plagued similar designs in the past do not exist. This is the case because only a limited area of the exterior surface 110 of the oil vessel actually contacts the inside surface of the sleeve so that abrasive rubbing or binding against the inside surface of the sleeve is avoided.

During installation, the oil vessel 102 is inserted through the open bottom 108 of the sleeve 106 until the inclined area 124 of the oil vessel contacts the inclined surface 150 of the sleeve 106. In this position, the oil vessel has reached the end of the travel through the sleeve and the bottom of the continuous sidewall 146 of the sleeve is essentially at the same level as the base 120 of the oil vessel. It should be noted, that notwithstanding the efforts to achieve certain engineering tolerances, the vessel and the sleeve will not properly fit together in the absence of the interference ring 104.

When the supply of fuel oil 136 is spent, the entire vessel 102 may be replaced simply by removing the chimney 114 and applying pressure to the top of the oil vessel 102 while firmly grasping the sleeve 106. When the downward force on the oil vessel exceeds the securing force between the interference ring 104 and the inside surface 112 of the sleeve, the vessel will be ejected from the open bottom 108 of the sleeve. Thereafter, a recharged oil vessel may be reinserted into the open bottom of the vessel by applying a force to the base 120 of the vessel as previously described. The replacement oil vessel must include the construction of the interference ring 104 for achieving a snug fit so that the vessel does not fall out of the sleeve.

It is noted that upon disassembly, the chimney 114, the sleeve 106, and the oil vessel 102 become separate units as shown in FIG. 2. It has been found that upon separating the components of the fuel oil lamp 100, that the sleeve 106 may be inverted so that the end of the chimney 114 (which includes the lip 158) may be inserted into the open bottom 108. Such an act is referred to as nesting and is an added convenient feature of the disclosed construction of the preferred embodiment for conserving space during packing and shipping of the fuel oil lamp 100.

From the foregoing, it will be appreciated that the fuel oil lamp 100 of the present invention allows for the creation of a sufficient securing force between the oil vessel 102 and the sleeve 106 for providing a snug fit therebetween while eliminating intolerable binding forces, and that the burning cycle of the oil lamp is extended by employing a large oil vessel. Further, the vessel is inserted through the bottom of the base sleeve 106 while permitting the easy removal of the vessel therefrom by applying a force to the top of the vessel after removing the chimney. Also, the lamp construction is simple and economical to produce, and since the oil lamp comprises only three main components, disassembly and convenient repositioning of the components accommodates packing and shipping.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A fuel oil lamp comprising, in combination:

containing means for storing a volume of fuel oil to be burned by said lamp;

a sleeve mounted over said containing means, said sleeve having an open bottom for receiving said containing means;

an interference ring formed on an exterior surface of said containing means, said interference ring being resilient and being compressed between said containing means and said sleeve for providing a force for securing said containing means to said sleeve;

delivering means extending from the interior of said containing means for drawing said volume of fuel oil out of said containing means; and illuminating means mounted on a top portion of said containing means for reflecting light provided by the burning of said fuel oil.

2. The fuel oil lamp of claim 1 wherein said containing means comprises an oil vessel, said oil vessel containing a large volume of fuel oil for extending the burning cycle of the lamp.

3. The fuel oil lamp of claim 1 wherein said containing means is replaceable.

4. The fuel oil lamp of claim 1 wherein said containing means is comprised of plastic.

5. The fuel oil lamp of claim 1 wherein said interference ring is molded to said containing means.

6. The fuel oil lamp of claim 1 wherein said containing means includes a base which supports the weight of the fuel oil lamp.

7. The fuel oil lamp of claim 1 wherein said sleeve is comprised of metal.

8. The fuel oil lamp of claim 1 wherein said delivering means comprises a wick.

9. The fuel oil lamp of claim 1 wherein said illuminating means comprises a chimney.

10. The fuel oil lamp of claim 1 wherein said illuminating means comprises a glass chimney.

11. The fuel oil lamp of claim 1 wherein said containing means includes a cylindrical portion having a shoulder formed at an interface between said cylindrical portion and said top portion of the containing means, said containing means shoulder contacting a congruent sleeve shoulder formed in a continuous sidewall of said sleeve for limiting the travel of said containing means through said open bottom of said sleeve.

12. A fuel oil lamp comprising, in combination:

an oil vessel for storing a volume of fuel oil to be burned by said lamp;

a sleeve mounted over said oil vessel, said sleeve having an open bottom for receiving said oil vessel;

an interference ring molded to an exterior surface of said oil vessel, said interference ring being resilient and being compressed between said oil vessel and said sleeve for providing a force for securing said oil vessel to said sleeve;

a wick extending from the interior of said oil vessel for drawing said volume of fuel oil out of said oil vessel; and a chimney mounted on a top portion of said oil vessel for reflecting light provided by the burning of said fuel oil.

13. A method of constructing a fuel oil lamp, said method comprising the steps of:

storing a volume of fuel oil to be burned by said lamp in an oil vessel;

sealing said oil vessel and extending a wick from the interior of said oil vessel for drawing on said volume of fuel oil;

mounting a sleeve over said oil vessel, said sleeve having an open bottom for receiving said oil vessel;

molding an interference ring to an exterior surface of said oil vessel, said interference ring being resilient and being compressed between said oil vessel and said sleeve for providing a force for securing said oil vessel to said sleeve; and mounting a chimney on a top portion of said oil vessel for reflecting light provided by the burning of said fuel oil.

14. The method of constructing a fuel oil lamp as recited in claim 13 further including the step of providing an oil vessel having a large capacity of fuel oil for extending the burning cycle of the lamp.

* * * * *

UNITED STATES PATENT AND TRADEMARK OFFICE

CERTIFICATE OF CORRECTION

PATENT NO. : 4,917,598

DATED : April 17, 1990

INVENTOR(S) : Daniel P. Stoner

It is certified that error appears in the above-identified patent and that said Letters Patent is hereby corrected as shown below:

Title page, left column, Field [73],
insert -- Assignee: Candle Lamp Company, Riverside, California --;
Column 2, line 11, delete "but" and substitute therefor -- and --;
Column 2, line 59, delete "oil vessel" and substitute therefor -- sleeve --;
Column 4, line 18, delete "but" and substitute therefor -- and --; and
Column 5, line 42, delete "3 $\frac{3}{8}$ " and substitute therefor -- 3 3/8" --.

Signed and Sealed this

Twenty-fifth Day of June, 1991

*Attest:*

HARRY F. MANBECK, JR.

*Attesting Officer*

*Commissioner of Patents and Trademarks*